US009350129B2

(12) United States Patent
Heimsch

(10) Patent No.: US 9,350,129 B2
(45) Date of Patent: May 24, 2016

(54) ELECTRONIC/ELECTRICAL CONNECTING ARRANGEMENT

(71) Applicant: H & B Electronic GmbH & Co. KG, Deckenpfronn (DE)

(72) Inventor: Jochen Heimsch, Fellbach (DE)

(73) Assignee: H & B ELECTRONIC GMBH & CO. KG, Deckenpfronn (DE)

( * ) Notice: Subject to any disclaimer, the term of this patent is extended or adjusted under 35 U.S.C. 154(b) by 39 days.

(21) Appl. No.: 14/404,653

(22) PCT Filed: Apr. 13, 2013

(86) PCT No.: PCT/EP2013/001090

§ 371 (c)(1),
(2) Date: May 26, 2015

(87) PCT Pub. No.: WO2013/178309

PCT Pub. Date: Dec. 5, 2013

(65) Prior Publication Data

US 2015/0303631 A1 Oct. 22, 2015

(30) Foreign Application Priority Data

May 31, 2012 (DE) ..... 20 2012 005 335 U

(51) Int. Cl.

| | |
|---|---|
| ***H01R 31/06*** | (2006.01) |
| ***H01R 4/24*** | (2006.01) |
| ***H01R 43/20*** | (2006.01) |
| ***H01R 43/26*** | (2006.01) |

(52) U.S. Cl.

CPC ..... *H01R 31/06* (2013.01); *H01R 4/242* (2013.01); *H01R 43/20* (2013.01); *H01R 43/26* (2013.01)

(58) Field of Classification Search

USPC ..... 439/651, 404, 409, 405, 418, 131, 188

See application file for complete search history.

(56) References Cited

U.S. PATENT DOCUMENTS

| | | | | |
|---|---|---|---|---|
| 3,691,327 | A * | 9/1972 | Abraham Chesler | H01R 31/00 200/43.02 |
| 4,592,614 | A * | 6/1986 | Myers, Jr. | H01R 31/06 439/404 |
| 4,842,546 | A * | 6/1989 | Song | H01R 4/2404 439/409 |
| 5,071,360 | A * | 12/1991 | Lindow | H01R 13/6395 200/43.02 |

(Continued)

FOREIGN PATENT DOCUMENTS

| | | | |
|---|---|---|---|
| DE | 202006018019 | U1 | 3/2008 |
| EP | 0531677 | A1 | 3/1993 |

(Continued)

*Primary Examiner* — Alexander Gilman

(74) *Attorney, Agent, or Firm* — Browdy and Neimark, PLLC

(57) ABSTRACT

The invention relates to an electronic/electrical connecting arrangement (2) with a first housing part (28) and a second housing part (30), which can be brought along an assembly axis (M1) into a connecting position in which they form a first connection contour (41), which is connectable to the first contacting element (4), and a second connection contour (50). A connecting conductor (22) is received in the housing of the connecting element (8), the connecting conductor having first contacting means (24) on the first connection contour (41) that can be brought into electrical/electronic contact with the first conductor (10) in a first contact plane (KE1), and second contacting means (26) on the second connection contour (50) that can be brought into electrical/electronic contact with the second conductor (20) in a second contact plane (KE2) different from the first contact plane (KE1).

20 Claims, 3 Drawing Sheets

(56) References Cited

Figure 1:
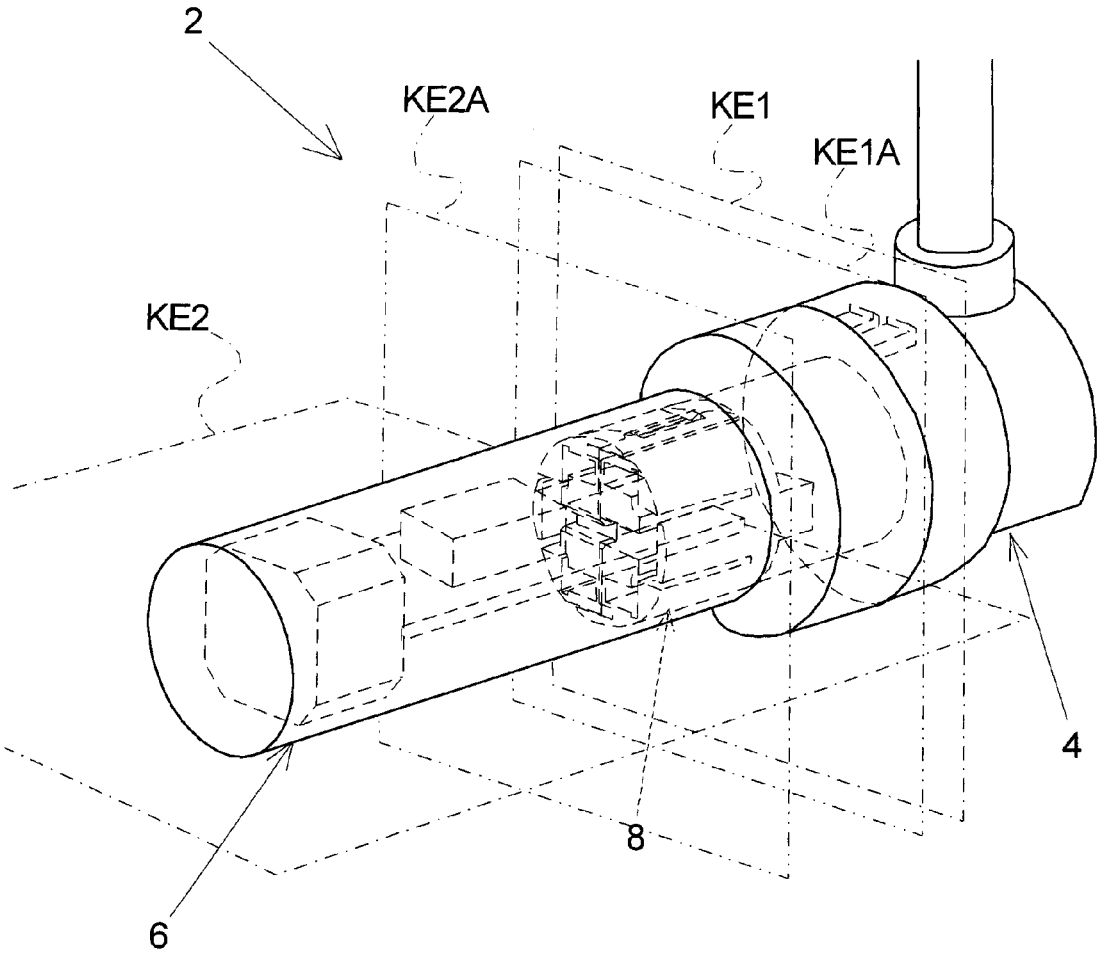

U.S. PATENT DOCUMENTS 5,989,071 A * 11/1999 Larsen ..... H01R 13/6467 439/418
6,984,153 B2 * 1/2006 Lai ..... H01R 35/04 439/135
7,753,721 B1 * 7/2010 Wu ..... H01R 13/6275 431/131
8,382,493 B2 * 2/2013 Ruffner ..... H01R 27/00 439/105
8,616,904 B1 * 12/2013 Martin ..... H01R 13/20 439/188
8,777,646 B2 * 7/2014 Doubt ..... H01R 13/7137 439/265
9,166,351 B1 * 10/2015 Wang ..... H01R 27/00
2009/0035987 A1 * 2/2009 Daly ..... H01R 4/36 439/502
2010/0221946 A1 * 9/2010 Neumetzler ..... H01R 31/005 439/405

FOREIGN PATENT DOCUMENTS

EP 0690523 A1 1/1996
EP 0899827 A2 3/1999

* cited by examiner

ELECTRONIC/ELECTRICAL CONNECTING ARRANGEMENT

The invention relates to an electronic and/or electrical connecting arrangement such as, for example, an at least partially pluggable connecting arrangement according to the preamble of claim 1, as well as to a connecting element of the connecting arrangement and to a modular system having at least two connecting arrangements. The invention further relates to a method for assembling such a connecting arrangement. A first contacting element having a first conductor and a second contacting element having a second conductor are provided in the connecting arrangement. Furthermore, a connecting element for establishing contact between the first conductor and the second conductor is provided, for which purpose the connecting element has a housing with a first housing part and a second housing part which can be brought along a first assembly axis into a connecting position. In this connecting position, the housing parts form a first connection contour which can be connected to the first contacting element, and a second connection contour which can be connected to the second contacting element. For this purpose, at least one connecting conductor is received in the housing of the connecting element, the connecting conductor having first contacting means on the first connection contour that can be brought into electrical/electronical contact with the first conductor in a first contact plane. On the second connection contour, the at least one connecting conductor has a second contacting means that can be brought into electrical/electronic contact with the second conductor in a second contact plane that is separated from the first contact plane.

A plug connection, in particular for sensor/actuator lines, by means of which a printed circuit board can be connected to a cable, is known from DE 202006018019 U1. For this purpose, a two-part connecting element is provided that has a base unit and an actuating element that is displaceable therein. Furthermore, connecting conductors having IDC contacts are provided in the base unit, which IDC contacts protrude into the actuating element in such a manner that when displacing the actuating element with the conductors of the stripped cable received therein, the conductor insulations of the conductors are penetrated by the IDC contacts and the conductor leads are contacted by the IDC contacts. Furthermore, the connecting conductors are connected with pin contacts which are arranged within a plug collar and which can be plugged into a complimentarily shaped contact socket of the printed circuit board.

The disadvantage of the known connecting arrangement is that in the case of different contacting elements, depending on the shape of the contacting elements and depending on how the first and second conductors are arranged in the first and the second contact plane, respectively, the connecting element has to shaped very differently or has to be replaced completely by another connecting element. In any case, during assembly of the connecting arrangements, many different movement sequences are required which, moreover, change with each exchange of the contacting elements to be assembled. Overall, this results in very high assembly expenses, in particular when assembling different pairs of contacting elements. Moreover, assembly of such contacting element pairs cannot be automated at all or only insufficiently.

It is the object of the invention to avoid the mentioned disadvantages in a generic connecting arrangement and to simplify assembly in particular in the case of different contacting element pairs that are to be connected.

This object is achieved by a connecting arrangement having the features of claim 1. The first housing part has first mechanical connecting means and the second housing part has second mechanical connecting means, each of which face an engagement face. These two engagement faces can be put together along a first assembly axis for the joint formation of the housing of the connecting element, wherein the mechanical connecting means can be connected to a counter connection contour of one of the contacting elements. Moreover, at least on one of the housing parts, the contacting means have a contact surface which is free in the direction of the engagement face and which, when establishing the connecting position along the first assembly axis, can be brought in electronic/electrical contact with a contact section that is exposed on the counter connection contour, wherein the contact surface is pressed with sufficient force against the contact section so as to ensure a stable electronic/electrical connection. When putting the two housing parts of the connecting element together in this manner, the latter can be connected at the same time to the corresponding contacting element, wherein the connection between the connecting element and the contacting element is carried out mechanically as well as with respect to an electronic/electrical contact. Through this, the assembly steps for producing the connecting arrangement are greatly simplified and can be standardized for many different contacting element pairs.

Advantageously, the free contact surface is formed by a contact terminal so that secure contacting and a durable electronic/electrical connection between the connecting element and the contacting element can be ensured.

In a particularly advantageous embodiment, the contact terminal is also formed as an insulation-displacement contact terminal so that even in the case that the contact section exposed at the counter connection contour of the corresponding contacting element still has insulation, the electronic/electrical contact between the connecting element and the contacting element can be established automatically.

Advantageously, two positive-locking means are provided on the housing parts that can be brought into engagement with second counter positive-locking means that are arranged on the counter connection contour. In this manner, a positive-locking fit can also be established between the connecting element and the corresponding contacting element, which ensures a permanently stable fixation of the connecting element on the contacting element.

Advantageously, at least two connecting conductors are received in the housing parts, which connecting conductors can be brought into contact, in particular from opposing sides along the first assembly direction, with a respective exposed contact section of one of the contacting elements when connecting the housing parts. In this manner, more than one electronic/electrical contacting can be established when attaching the connecting element to the counter connection contour of the corresponding contacting element.

Furthermore, it is beneficial if the respective other connection contour can be brought along a second assembly axis that is preferably perpendicular to the first assembly axis into electronic/electrical contact with the respective other contacting element. This enables establishing the electronic/electrical connection in a particularly simple manner between the two contacting elements via the connecting element, which can also be carried out at least partly automated in a relatively simple manner.

In another advantageous embodiment, the respective other connection contour has a plug device for establishing a plug connection to a counter plug device of the respective other contacting element. In this manner, for example, the connecting element can be connected in a permanently stable manner to one of the contacting elements by receiving the counter connection contour thereof in the receiving chamber formed by the housing parts, while the connecting element is connected to the other contacting element via a plug connection that can be established in a quick and simple manner and can also be released again. In this manner, the connecting element represents a kind of an adaptor that is attached to one of the contacting elements so that even in the case of different contacting means, the first contact plane arranged thereon can be connected to the second contact plane arranged on the second contacting element.

Moreover, the object is achieved by a connecting element that is suitable for use in a connecting arrangement in one of the above-described embodiments, wherein the housing parts form at least one conductor receptacle in which one of a plurality of different embodiments of the connecting conductor can be received. In this manner, the connecting element can be adapted to different embodiments of the contacting elements or their exposed contact sections simply by replacing the conductor receptacle.

Advantageously, the two housing parts and, in a particularly advantageous embodiment, also the connecting conductors received therein are designed as carry-over parts, whereby the overall production costs of the connecting element and thus of the connecting arrangement can be reduced.

Moreover, it is beneficial if the housing parts have first positive locking means and first counter positive locking means, for example in the form of latching means and counter latching means, by means of which they can be fixed to one another in the connecting position. Hereby, the receiving chamber formed by the housing parts with the counter connection contour of the contacting element received therein can be kept closed in a permanently stable manner.

Furthermore, the object is achieved by a modular system having at least two connecting arrangements according to any one of the above-mentioned embodiments, which differ from one another in at least one of the contacting elements, wherein the first and the second assembly axes in the two connecting arrangements are aligned in the same way. Due to this match in the alignment of the assembly axis, the at least two connecting arrangements of the modular system can be assembled in a corresponding manner. Thus, even when changing the embodiments of the connecting arrangements, no significant changeovers are necessary during assembly, which, on the one hand, simplifies assembly and, in particular, enables an at least partly automated assembly.

It is beneficial if the connecting elements of both connecting arrangements have an identical length, whereby in addition to the alignments of the assembly axes, the lengths of the assembly movements can also be brought in accordance with one another at least partially, whereby in particular automated assembly of different connecting arrangements is greatly simplified.

It is particularly advantageous if the connecting elements have identical housings, which enables a particularly simple and, for example, fully automated assembly of different connecting arrangements.

In an advantageous embodiment, the free contact sections and the contacting means of one of the connecting arrangements are adapted to one another in such a manner that this connecting arrangement has at least one contact plane that is displaced with respect to the contact planes of the other connecting arrangements. This can in particular be achieved by a different arrangement of the contacting means of the connecting element. Through this, the modular system consisting of connecting arrangements which can be assembled in identical assembly steps can also comprise contacting elements with very different counter connection contours, as a result of which the modular system can cover a particularly wide range of connecting elements.

Furthermore, it can be an advantage here if the respective displaced contact plane is formed in addition to the first contact plane, whereby the modular system can be designed in an even more variable manner. Forming the displaced contact planes can be carried out by positioning first contacting means or second contact means in each case at different heights.

Furthermore, the mentioned object is achieved by a method for producing a connecting arrangement in one of the above-mentioned embodiments, wherein in a first step, the connecting conductor is fixed in the housing parts of the connecting element with the contact means that are adapted to the provided contacting elements, and in a subsequent step, the housing parts are fixed to one another along the first assembly direction with the counter connection contour of one of the contacting elements being arranged therebetween. In the process of this, the mechanical connecting means of the connecting element are fixed on the counter connection contour of the corresponding contacting element and, at the same time, the contacting means of the connecting element are slid onto the contact section of the contacting element. By means of the connection of the two housing parts of the connecting element established here with the connection contour of the one contacting element arranged therebetween, the simultaneous mechanical fixation of the connecting element on the contacting element and the electronic/electrical contacting of both elements is made possible.

It is beneficial if by placing the receiving chamber against counter connection contour a positive-locking fit is established between the connecting element and the contacting element, which enables a permanently stable fastening of the connecting element on the contacting element.

Furthermore, it is beneficial here if the contact section of the conductor of the contacting element exposed at the counter connection contour has a main longitudinal extent and if during fixing the two housing parts to one another, the contact means are slid onto the housing parts substantially perpendicular to the main longitudinal extent, and/or if in a further subsequent step, the connection contour of the respective other contacting element is connected along the second assembly axis to the other connection contour of the connecting element, wherein the second assembly axis is aligned perpendicular to the first assembly axis.

In a further advantageous embodiment, the contacting means of the connecting element are also brought in engagement on the conductor of the other contacting element when connecting the other contacting means to the connecting element and, at the same time, a positive-locking connection is established in the direction of the second assembly axis. In this manner, a permanently stable connection between the contacting elements via the connecting element can be ensured for the entire connecting arrangement from a mechanical as well as electronic/electrical point of view.

Figure 2:
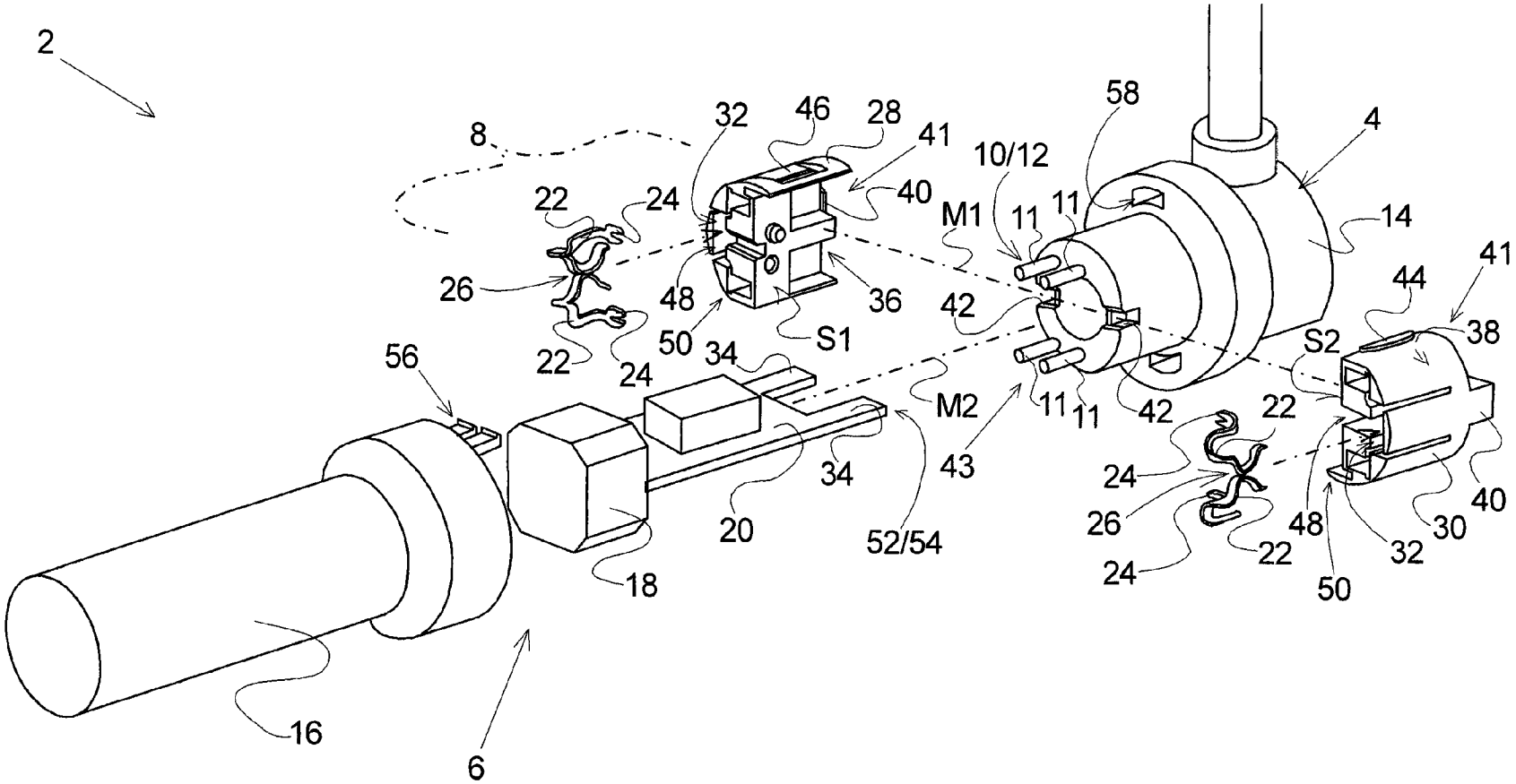
Figure 3:
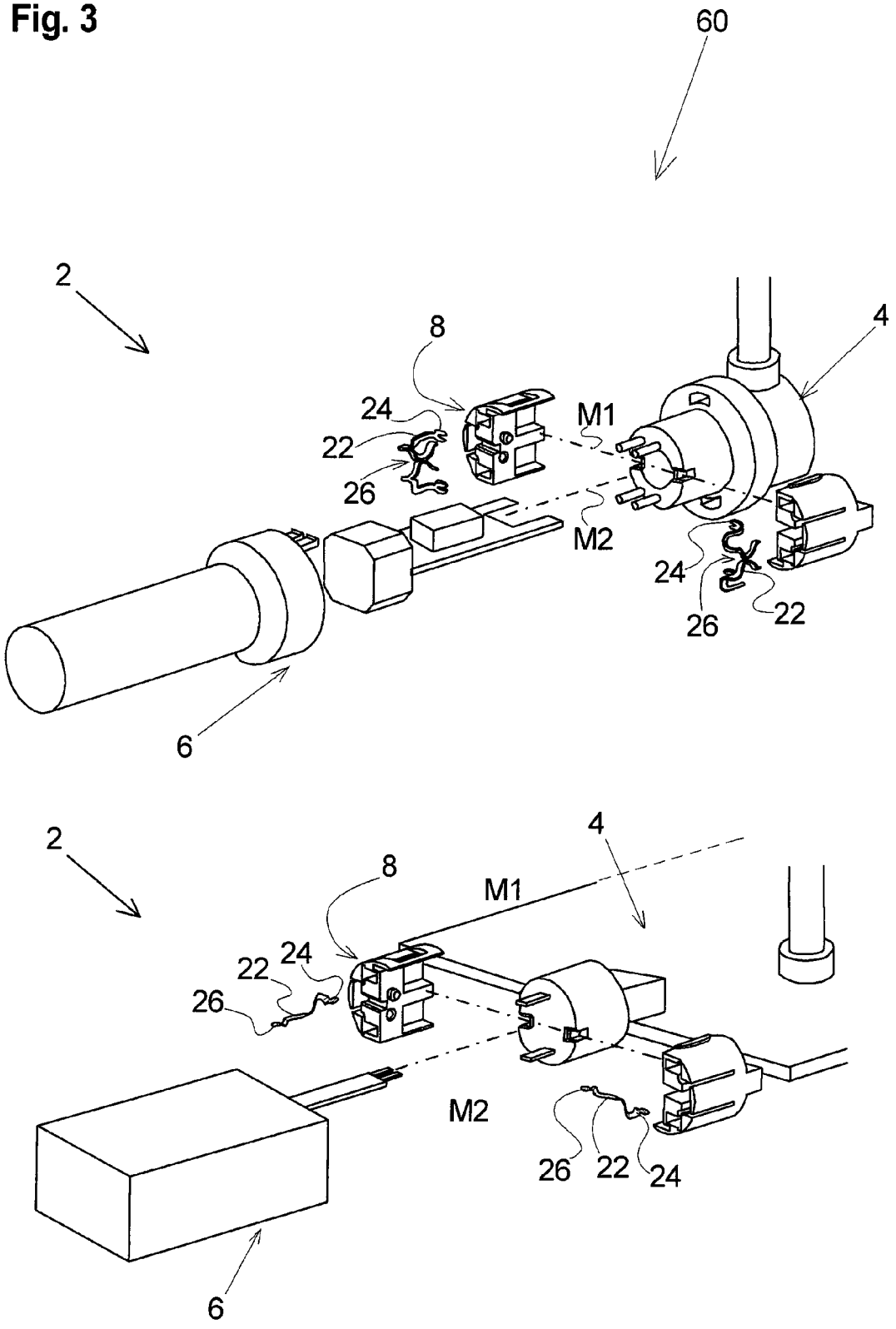

An exemplary embodiment of the invention is illustrated in the figures. In the figures:

FIG. 1 shows a perspective illustration of a connecting arrangement according to the invention, FIG. 2 shows an exploded illustration of the connecting arrangement according to FIG. 1, and FIG. 3 shows an exploded illustration of a modular system according to the invention.

FIG. 1 shows a connecting arrangement 2 having a first contacting element 4 which, as an example, is formed by a functional unit such as a sensor, and having a second contacting element 6 which, as an example, is formed by a connection unit having a connected supply/data cable. In the illustrated completely assembled state of the connecting arrangement 2, the first contacting element 4 is mechanically and electronically or electrically connected to the second contacting element 6 via a connecting element 8.

As is apparent in particular from FIG. 2, the first contacting element 4 has a first electronic/electrical conductor 10 with a plurality of insulated strands 11 which protrude over a free contact section 12 out of the housing 14 of the first contacting element 4. As an alternative to this, the electronic/electrical conductor 10 in the contact section 12 can also have solid wires or round contacts.

The second contacting element 6 has a housing 16 in which electronics 18 with a printed circuit board forming a second electrical conductor 20 is received.

For establishing an electronic/electrical contact between the first conductor 10 and the second conductor 20, the connecting element 8 has connecting conductors 22, each of which forms at the ends thereof first contacting means 24 for contacting the first conductor 10 and second contacting means 26 for contacting the second conductor.

In the illustrated embodiment of the connecting arrangement 2, a total of four connecting conductors 22 are provided, which are each received in pairs in a first housing part 28 and a second housing part 30 of the connecting element 8.

The two housing parts 28, 30, which together form a two-part housing of the connecting element 8, each have a conductor receptacle 32 in which different embodiments of the connecting conductors 22 can be received in order to be able to adapt the connecting element 8 to different embodiments of the contacting elements 4, 6.

In the illustrated exemplar embodiment, the first contacting means 24 facing towards the first contacting element 4 have insulation-displacement contact terminals. By means of the latter, the insulated strands 11 of the first conductor 10 can be electronically/electrically contacted at the free contact sections 12 by penetrating the respective insulation and engaging on the respective strand.

On the side facing towards the second contacting means 6, the second contacting means 26 arranged in pairs each form a spring-loaded contact terminal into which corresponding free contact sections 34 of the second conductor 20 can be plugged.

Furthermore, the first housing part 28 forms a first sub-chamber 36 that is open towards an engagement face S1 of the first housing part 28, and the second housing part 30 forms a second sub-chamber 38 that is open towards an engagement face S2 of the second housing part 30.

Moreover, hook-shaped first positive locking means 40 are provided in the region of the sub-chambers 36, 38 on both housing parts 28, 39. The sub-chambers 36, 38 and the first positive locking means 40 together function as mechanical connecting means for fixing the connecting element 8 to the first contacting means 4, and in an assembled state, they form a joint connection contour 41 of the connecting element.

The first positive locking means 40 of the housing parts 28, 30 can be brought into engagement with complementarily shaped counter positive locking means 42 which are recessed in a side of the housing 14 of the first contacting element 4, from which side the free contact sections 12 of the first conductor 10 also protrude. This side of the housing 14 thus forms a counter connection contour 43 that is formed to be at least partially complementary to the connection contour 41.

Furthermore, the two housing parts 28, 30 each have a second positive locking means 44 formed by a latching nose that can be latched in a connecting position with a second counter positive locking means 46 formed by a latching receptacle of the respective other housing part 30, 28. In a preferred embodiment of the connecting element 8, the two housing parts 28, 30 can be formed by identical parts that can be latched to one another in a position rotated relative to one another by 180° (not illustrated).

For electronically/electrically connecting the connecting arrangement 2 in an operative manner, the connecting conductors 22 in the illustrated embodiment are first inserted into the conductor receptacles 32 in such a manner that the first contacting means 24 are arranged in the respective sub-chamber 36; 38. At the same time, the second contacting means 26 are arranged on a slot-shaped plug device 48 that is recessed in the housing parts 28, 30 on a side facing away from the first positive locking means 40.

Subsequently, the two housing parts 28, 30 are brought along a first assembly axis M1 into a connecting position at the counter connection contour 43 of the first contacting element 4, in which connecting position the positive-locking means 40 of the resulting common first connection contour 41 come into engagement with the first counter positive locking means 42 of the counter connection contour 43 of the first contacting element 4. At the same time, the first contacting means 24 are moved along the first assembly axis M1 onto the free contact sections 12, wherein the first assembly axis M1 is aligned substantially perpendicular to a main longitudinal extent of the free contact sections 12. Here, the insulation of the free contact section 12 is cut through and electronic/electrical contact between the first conductor 10 and the connecting conductor 22 is established. Moreover, upon reaching the connecting position, both housing parts 28, 30 are latched to one another via the second positive locking means 44 and the counter positive locking means 46 so that they are held together in a positive-locking manner in the direction of the first assembly axis M1 and, moreover, the positive-locking fit acting perpendicular thereto between the first positive locking means 40 and the counter positive locking means 42 can no longer be released. In this connection position according to FIG. 1, the connecting element 8 is mechanically as well as electronically/electrically connected to the first contacting element 4 in a permanently stable manner.

On the side facing away from the first contacting element 4, the two housing parts 28, 30 together with the slot-shaped plug device 48 form a second connection contour 50 which can be connected to a second counter connection contour 52 of the second contacting element 6. The second counter connection contour is substantially formed by a counter plug device 54 that can be connected along a second assembly axis M2 to a plug device 50 of the connecting element 8 so as to form an easily connectable and easily disconnectible plug connection. The counter plug device 54 in turn is formed by the free contact sections 34 of the second conductor 20 which, by inserting them along the second assembly axis into the plug device 48, come into contact with the second contact means 26 of the connecting conductor 22.

Finally, the housing 16 of the second contacting element 6 can then be slid over the electronics 18 and can be brought via fixing means 56 into a positive-locking connection with counter fixing means 58 of the housing 14 of the first contacting element 4, which positive-locking connection acts in the direction of the second assembly axis M2.

In the completely assembled state of the connecting arrangement 2, the first contacting means 24 together with the first conductor 10 of the first contacting element 4 thus define a first contact plane KE1, and the second contact means 26 together with the second conductor 20 of the second contacting elements 6 form a second contact plane KE2 according to FIG. 1, which is spaced apart from and aligned perpendicular to the first contact plane and which is electronically/electrically connected to the first contact plane via the connecting element 8.

FIG. 3 shows a modular system 60 comprising at least two of the connecting arrangements 2 according to the invention, which can be assembled along corresponding first and second assembly axes M1, M2, but have different first and second contacting elements 4, 6 and different free contact sections 12, 34.

In order to nevertheless enable a corresponding assembly process, different connecting conductors 22 each with adapted first and second contacting means 24, 26 are received in the connecting elements 8. The contacting means can be formed from contact terminals, spring contacts, direct plug contacts or all other known and suitable contact types, for example.

The free contact sections 12, 34 and the contacting means 24, 26 in at least one of the connecting arrangements 2 can be adapted to one another in such a manner that at least one of the contact planes KE1, KE2 is displaced, as illustrated in FIG. 1 by KE1A and KE2A. Moreover, the contact sections 12, 34 and the contacting means 24, 26 can be adapted to one another in such a manner that at least one of the connecting arrangements 2 forms at least two contact planes KE1, KE1A; KE2, KE2A which are offset to one another or are at an angle to one another.

The invention claimed is:

1. An electronic/electrical connecting arrangement (2) with a first contacting element (4) having a first conductor (10), a second contacting element (6) having a second conductor (20)

and a connecting element (8) for establishing a contact between the first conductor (10) and the second conductor (20), the connecting element having a housing for this purpose with a first housing part (28) and a second housing part (30), which can be brought along a first assembly axis (M1) into a connecting position in which they form a first connection contour (41), which is connectable to the first contacting element (4), and a second connection contour (50) which is connectable to the second contacting element (6) along a second assembly axis (M2) different from the first assembly axis (M1), wherein for this purpose, a connecting conductor (22) is received in the housing of the connecting element (8), the connecting conductor having first contacting means (24) on the first connection contour (41) that can be brought into electrical/electronical contact with the first conductor (10) in a first contact plane (KE1), and second contact means (26) on the second connecting contour (50) that can be brought into electrical/electronical contact with the second conductor (20) in a second contact plane (KE2) that is different from the first contact plane (KE1), characterized in that the first housing part (28) has first mechanical connecting means and the second housing part (30) has second mechanical connecting means, each of which are facing towards an engagement face (S1, S2), and the two engagement faces (S1, S2) can be put together along the first assembly axis (M1) for the joint formation of the housing of the connecting element (8), wherein the mechanical connecting means can be connected to a counter connection contour (43) of one of the contacting elements (4; 6), and the contacting means (24, 26) have a contact surface at least on one of the housing parts (28, 30), which contact surface is free in the direction of the engagement face (S1, S2) and which, when establishing the connecting position along the first assembly axis (M1), can automatically be brought in electronic/electrical contact with a contact section (12) that is exposed on the counter connection contour (43).

2. The connecting arrangement according to claim 1, characterized in that the free contact surface is formed by a contact terminal.

3. The connecting arrangement according to claim 2, characterized in that the contact terminal is formed as an insulation-displacement contact terminal.

4. The connecting arrangement according to claim 1, characterized in that first positive locking means (40) are provided on the housing parts (28, 30), which can be brought into engagement with first counter positive locking means (42) that are arranged on the counter connection contour (43).

5. The connecting arrangement according to claim 1, characterized in that at least two connecting conductors (22) are received in the housing parts (28, 30).

6. The connecting arrangement according to claim 1, characterized in that the respective other connection contour (50) can be brought along the second assembly axis (M2) into electrical/electronic contact with the respective other contacting element (6).

7. The connecting arrangement according to claim 6, characterized in that the respective other connection contour (50) has a plug device (48) for establishing a plug connection with a counter plug device (54) of the respective other contacting element (6).

8. A connecting element for a connecting arrangement according to claim 1, characterized in that at least one conductor receptacle (32) is provided into which one of a plurality of embodiments of the connecting conductor (22) can be inserted.

9. The connecting element according to claim 8, characterized in that the two housing parts (28, 30) are designed as carry-over parts.

10. The connecting element according to claim 8, characterized in that the housing parts (28, 30) have second positive locking means (44) and second counter positive locking means (46) by means of which they can be fixed to one another.

11. A modular system comprising at least two connecting arrangements (2) according to claim 1, which differ from one another at least in one of the contacting elements (4, 6), characterized in that the first and second assembly axes (M1, M2) in the two connecting arrangements (2) are aligned in the same way.

12. The modular system according to claim 11, characterized in that the connecting elements (8) of the two connecting arrangements (2) have an identical length.

13. The modular system according to claim 11, characterized in that the connecting elements (8) have identical housings.

14. The modular system according to claim 11, characterized in that the free contact sections (12, 34) and the contacting means (24, 26) of one of the connecting arrangements (2) are adapted to one another in such a manner that this connecting arrangement (2) has a at least one contact plane (KE1A, KE2A) that is displaced with respect to the contact planes (KE1, KE2) of the other connecting arrangements (2).

15. The modular system according to claim 14, characterized in that the displaced contact plane (KE1A, KE2A) is formed in addition to the contact plane (KE1, KE2).

16. A method for producing a connecting arrangement according to claim 1, characterized in that a) in a first step, the connecting conductor (22) is fixed in the housing parts (28, 30) of the connecting element (8) with contacting means (24, 26) that are adapted to the provided contacting elements (4, 6), b) in a subsequent step, the housing parts (28, 30) are fixed to another along the first assembly direction (M1) with the counter connection contour (43) of the one of the contacting elements (4) being arranged therebetween, wherein the mechanical connecting means of the connecting element (8) are fixed on the connection contour (43) of the corresponding contacting element (4) and, at the same time, the contacting means (24) of the connecting element (4) are slid onto the contact section (12) of the contacting element (4).

17. The method according to claim 16, characterized in that when fixing the mechanical connecting means to the counter connection contour (43), a positive-locking fit is established between the connecting element (8) and the contacting element (4).

18. The method according to claim 16, characterized in that the contact section (12) of the conductor (10) of the contacting element (4) exposed at the connection contour (43) has a main longitudinal extent, and when fixing the two housing parts (28, 30) to one another, the contacting means (24) are slid onto the contact section substantially perpendicular to the main longitudinal extent.

19. The method according to claim 16, characterized in that in a further subsequent step, the counter connection contour (52) of the respective other contacting element (6) is connected along the second assembly axis (M2) to the other connection contour (50) of the connecting element (8), wherein the second assembly axis (M2) is aligned perpendicular to the first assembly axis (M1).

20. The method according to claim 19, characterized in that when connecting the other contacting element (6) to the connecting element (8), the contacting means (26) thereof are engaged with the conductor (20) of the other contacting element (6) and, at the same time, a positive-locking connection is established in the direction of the second assembly axis (M2).

* * * * *